US011719181B2

(12) United States Patent
Williams et al.

(10) Patent No.: US 11,719,181 B2
(45) Date of Patent: Aug. 8, 2023

(54) INTERNAL COMBUSTION ENGINE CONTROLLER

(71) Applicant: Perkins Engines Company Limited, Peterborough (GB)

(72) Inventors: Gavin Williams, Stamford (GB); Peter Ladlow, Bourne (GB)

(73) Assignee: Perkins Engines Company Limited, Peterborough (GB)

( * ) Notice: Subject to any disclaimer, the term of this patent is extended or adjusted under 35 U.S.C. 154(b) by 0 days.

(21) Appl. No.: 17/606,623

(22) PCT Filed: Apr. 24, 2020

(86) PCT No.: PCT/EP2020/025187
§ 371 (c)(1),
(2) Date: Oct. 26, 2021

(87) PCT Pub. No.: WO2020/216472
PCT Pub. Date: Oct. 29, 2020

(65) Prior Publication Data

US 2022/0235721 A1 Jul. 28, 2022

(30) Foreign Application Priority Data

Apr. 26, 2019 (GB) ..... 1905877

(51) Int. Cl.
*F02D 41/24* (2006.01)
*F02D 41/14* (2006.01)

(52) U.S. Cl.
CPC ..... *F02D 41/248* (2013.01); *F02D 41/1401* (2013.01); *F02D 41/2464* (2013.01); *F02D 41/2474* (2013.01)

(58) Field of Classification Search
USPC ..... 701/103, 114
See application file for complete search history.

(56) References Cited

U.S. PATENT DOCUMENTS 4,379,332 A * 4/1983 Busser ..... F02D 41/26 123/480
6,178,373 B1 * 1/2001 Davis ..... F02D 41/1458 123/406.47

(Continued)

FOREIGN PATENT DOCUMENTS

DE 10020448 A1 10/2001
DE 102008004382 A 7/2009

(Continued)

OTHER PUBLICATIONS

D. Kościelnik, "Algorithms of real-time correction of the fuel map and the ignition map of a race combustion engine with spark ignition," 2010 IEEE International Symposium on Industrial Electronics, 2010, pp. 62-67, doi: 10.1109/ISIE.2010.5637896. (Year: 2010).*

(Continued)

*Primary Examiner* — Sizo B Vilakazi
*Assistant Examiner* — Brian R Kirby

(57) ABSTRACT

An internal combustion engine controller for controlling an internal combustion engine is provided. The internal combustion engine controller comprises a memory and a processor. The memory is configured to store a plurality of control maps, each control map defining a hypersurface of actuator setpoints for controlling an actuator of the internal combustion engine based on a plurality of input variables to the internal combustion engine controller. The processor comprises an engine setpoint module and a map updating module. The map updating module is configured to optimise one or more of the hypersurfaces of the control maps at the location defined by the plurality of input variables. The map updating module comprises an optimiser module configured to search for an optimised group of actuator setpoints wherein the map updating module updates the one or more hypersurfaces at the location defined by the plurality of input (Continued)

variables based on the optimised group of actuator setpoints. A method of controlling an internal combustion engine is also provided.

18 Claims, 8 Drawing Sheets

(56) References Cited

U.S. PATENT DOCUMENTS 6,240,343 B1 5/2001 Sarangapani et al.
6,965,826 B2 * 11/2005 Andres ..... F02D 41/021 701/115
7,047,125 B1 * 5/2006 He ..... F02D 41/2432 701/111
7,177,758 B2 * 2/2007 Kruse ..... G01M 15/05 73/114.61
7,204,236 B2 4/2007 Ma et al.
7,415,389 B2 * 8/2008 Stewart ..... G05B 11/42 702/185
7,487,031 B2 * 2/2009 Yasui ..... F02D 41/1401 123/347
7,577,483 B2 * 8/2009 Fan ..... G05B 11/32 700/29
7,676,316 B2 3/2010 Lunati et al.
7,853,395 B2 * 12/2010 Guo ..... F02D 41/2432 701/102
7,996,140 B2 * 8/2011 Stewart ..... G05B 13/048 701/102
8,977,373 B2 * 3/2015 Felty ..... G05B 13/02 700/79
9,146,545 B2 * 9/2015 Stewart ..... G05B 13/02
9,217,387 B2 12/2015 Loeffler et al.
9,650,934 B2 * 5/2017 Pachner ..... F01N 3/208
10,030,602 B2 7/2018 Vaughan
2007/0156363 A1 * 7/2007 Stewart ..... G05B 11/42 701/100
2007/0203864 A1 * 8/2007 Grichnik ..... F02D 41/2432 706/44
2011/0301723 A1 12/2011 Pekar et al.
2018/0347498 A1 12/2018 Maloney
2019/0085780 A1 3/2019 Liao-Mcpherson et al.
2020/0049089 A1 * 2/2020 Charbonnel ..... F02D 41/1462

FOREIGN PATENT DOCUMENTS

EP 2116836 A1 11/2009
EP 2505812 A1 10/2012
EP 3258089 A1 12/2017

OTHER PUBLICATIONS

J. Gao, Y. Zhang and T. Shen, "An On-Board Calibration Scheme for Map-Based Combustion Phase Control of Spark-Ignition Engines," in IEEE/ASME Transactions on Mechatronics, vol. 22, No. 4, pp. 1485-1496, Aug. 2017, doi: 10.1109/TMECH .2017.2696788. (Year: 2017).*
International Search Report related to Application No. PCT/EP2020/025187; reported on Jul. 24, 2020.
Great Britain Search Report related to Application No. 1905877.5; reported on Oct. 28, 2019.
Kristian Jankov, "Beitrag zur automatisierten Steuerkennfeld-Applikation bei Fahrzeug-Dieselmotoren", Tag der wissenschaftlichen Aussprache, Jul. 31, 2008.
Anonymous, "Golden-section search", Wikipedia, Jul. 15, 2020.

* cited by examiner

Input Variable 2

Input Variable 1

| | 500 | 1000 | 1500 | 2000 | 2500 | 3000 | 3500 | 4000 |
|---|---|---|---|---|---|---|---|---|
| 0.2 | 1 | 1 | 3 | 3 | 3 | 3 | 3 | 3 |
| 0.4 | 1 | 2 | 3 | 3 | 3 | 3 | 3 | 3 |
| 0.6 | 3 | 3 | 3 | 3 | 3 | 3 | 3 | 3 |
| 0.8 | 3 | 3 | 3 | 3 | 3 | 3 | 3 | 3 |
| 1 | 3 | 3 | 3 | 3 | 3 | 3 | 3 | 3 |
| 1.2 | 3 | 3 | 3 | 3 | 3 | 3 | 3 | 3 |
| 1.4 | 3 | 3 | 3 | 4 | 5 | 5 | 5 | 5 |
| 1.6 | 3 | 3 | 3 | 4 | 6 | 7 | 7 | 7 |
| 1.8 | 3 | 3 | 4 | 4 | 5 | 8 | 9 | 9 |
| 2 | 3 | 4 | 5 | 6 | 7 | 8 | 10 | 11 |

31

INTERNAL COMBUSTION ENGINE CONTROLLER

CROSS-REFERENCE TO RELATED APPLICATION

This Application is a 35 USC § 371 US National Stage filing of International Application No. PCT/EP2020/025187 filed on Apr. 24, 2020 which claims priority under the Paris Convention to Great Britain Patent Application No. 1905877.5 filed on Apr. 26, 2019.

FIELD OF THE DISCLOSURE

The present disclosure relates to the control of an internal combustion engine. More specifically this disclosure relates to a system and method for controlling the actuators of an internal combustion engine.

BACKGROUND

Internal combustion engines often include one or more systems for managing the emissions output from the exhaust of the internal combustion engine. For example, internal combustion engines often include an after-treatment system for treating the exhaust gas produced by the internal combustion engine.

Typical after-treatment systems may include many sensors and (control) actuators. Further sensors and actuators may be provided in the internal combustion engine for monitoring exhaust gas, performance, and/or efficiency of the internal combustion engine. As such, internal combustion engines may include many independent controllable variables and calibration values. Thus, the design of an engine control system for an internal combustion engine is a multi-dimensional control problem.

Engine control systems need to provide setpoints to the actuators of the internal combustion engine in response to real time changes in the operating conditions of the internal combustion engine. The desire for high efficiency internal combustion engines which meet emissions regulations places a further restraint on the design of a control system. A further restraint on the design of the control system is that the amount of computing power available to the engine control system may be limited.

Conventionally, control of the internal combustion engine and after-treatment system is managed by an on-board processor (an engine control module). Due to the complexity of the internal combustion engine and after-treatment system, the engine control implemented typically utilises an open loop control system based on a series of "control maps" comprising pre-calibrated, time-invariant engine setpoints for the internal combustion engine and after-treatment system. Typically, the engine setpoints controlled include fuel mass, start of injection (SOI), exhaust gas recirculation (EGR) and inlet manifold absolute pressure (IMAP).

Some simple control maps comprise a plurality of look up tables, in which a number of time-invariant engine setpoints are stored associated with different engine operation conditions. An engine control module can simply read out engine setpoints from the control map associated with a desired engine operation. Some engine control maps can also provide estimates of one variable as a function of a limited number of other variables. Engine setpoint maps can only be based on a limited number of input variables due to the exponential increase in memory and map complexity as additional variables are included. In some cases, system memory can be compromised, but at the expense of interpolation error.

One method for reducing effects on performance of open-loop control scheme is to provide different control maps for different operating regimes. For example, different control maps may be provided for idle operation and full throttle operation, or start-up. Providing many different control maps per internal combustion engine makes calibration of each internal combustion engine expensive and time consuming. Furthermore, these pre-calibrated maps are each time-invariant lookup tables. Accordingly, these time-invariant control maps cannot take account of part-to-part variations in engine parts, or unmeasured influences like humidity for example. Time-invariant control maps also cannot accommodate variations in engine part performance over time.

An alternative approach is to implement real-time, on-board, model-based control of the engine to replace the pre-calibrated control maps. As such, an engine model directly controls one or more of the setpoints of the internal combustion engine. Model-based engine controls may include dynamic engine models to predict engine performance, emissions and operating states. Predicted engine performance can be fed back into the model to further optimise the engine setpoints. As such, model-based control methods effectively incorporate a form of negative feedback into the engine control system in order to improve performance and emissions.

Model-based control is difficult to implement as the engine setpoints must be calculated in real-time. Accordingly, model-based engine controllers including predictive elements ideally complete their predictions in real time as well. Thus, many model-based control schemes require significant computational resources to optimise model output within a suitable timescale for controlling an internal combustion engine.

SUMMARY OF THE DISCLOSURE

According to a first aspect of the disclosure, an internal combustion engine controller is provided. The internal combustion engine controller comprises a memory and a processor. The memory is configured to store a plurality of control maps, each control map defining a hypersurface of actuator setpoints for controlling an actuator of the internal combustion engine based on a plurality of input variables to the internal combustion engine controller. The processor comprises an engine setpoint module and a map updating module. The engine setpoint module is configured to output an actuator setpoint to each actuator based on a location on the hypersurface of the respective control map defined by the plurality of input variables. The map updating module is configured to optimise one or more of the hypersurfaces of the control maps at the location defined by the plurality of input variables. The map updating module comprises an optimiser module. The optimiser module is configured to search for an optimised group of actuator setpoints by:

(i) performing a stratified sample of an initial actuator setpoint search space of the control maps in order to select a first set of candidate groups of actuator setpoints, and evaluating the first set of candidate groups of actuator setpoints according to a performance model of the internal combustion engine to calculate a cost associated with each of the first set of candidate groups of actuator setpoints, (ii) determining a search line in the initial actuator setpoint search space which spans a first cost minima based on the costs associated with the first set of candidate groups of actuator setpoints;

(iii) performing a line search along the search line to calculate an optimised group of actuator setpoints associated with the first cost minima;

wherein the map updating module updates the one or more hypersurfaces at the location defined by the plurality of input variables based on the optimised group of actuator setpoints.

Accordingly, the internal combustion engine controller comprises two processing modules: an engine setpoint module and a map updating module. The engine setpoint module is configured to control a plurality of actuators of an internal combustion engine. For example, the engine setpoint module may control one or more of SOI, EGR, fuel mass, and inlet manifold absolute pressure requested (IMAPR) for an internal combustion engine. The engine setpoint module controls these actuators based on a performance input to the internal combustion engine, for example a user demand for torque, engine speed etc, or specified sensor data from the internal combustion engine (e.g. current IMAP). The control of each actuator is determined based on a control map for each actuator. Each control map defines a hypersurface for controlling an actuator of the internal combustion engine based on a plurality of input variables to internal combustion engine controller. As such, the engine setpoint module is effectively an open loop control module which utilises the actuator setpoints stored in the control maps to control the actuators.

The map updating module effectively operates independently from the open loop control of the engine setpoint module. The map updating module is configured to optimise the control of the internal combustion engine by updating the hypersurfaces of the control maps at a location defined by the input variables. As there are a plurality of actuators to be controlled, optimising the hypersurfaces is a multidimensional optimisation problem. The internal combustion engine controller according to the first aspect provides a map updating module which aims to solve the multidimensional optimisation problem in real time in computationally efficient manner. As such, the map updating module is designed with the computational resources available to an on-board engine control module of an internal combustion engine in mind.

In order to optimise the hypersurfaces, a performance model of the internal combustion engine is used to evaluate the performance of the internal combustion engine for candidate group of actuator setpoints and determine a cost. The cost determined may reflect one or more performance characteristics of the internal combustion engine as defined by the performance model. The performance model may take into account other input parameters available to the internal combustion engine controller, for example the input variables to the control maps, other sensor data and/or aftertreatment information. Consequently, the performance model of the internal combustion engine may be highly non-linear. Due to the multidimensional nature of the actuator setpoint search space, the performance model output may define a number of local minima, in addition to a global minimum. The optimiser module of the first aspect is configured to search for a group of optimised actuator setpoints which corresponds to the global minimum. By starting the search procedure from a stratified sample of the actuator setpoint search space, the optimiser module aims to reduce or eliminate the likelihood of the search arriving at a local minimum.

Accordingly, the optimiser module is arranged to calculate optimised setpoints on-board the internal combustion engine controller. As such, the optimiser module calculates optimised actuator setpoints during operation of the internal combustion engine. The search methodology of the optimiser module is adapted accordingly to output optimised setpoints in real-time using the (limited) available processing power the internal combustion engine controller. That is to say, the search methodology of the optimiser module is adapted to real-time operation, rather than a search methodology which can be performed off-line without restrictions on available computing power.

By providing a plurality of updatable control maps, a control map based controller may be provided which can be optimised to a range of different operating points using a limited number of control maps. Thus, the number of control maps that need to be calibrated for an internal combustion engine may be reduced, as the updatable maps of this disclosure may provide control covering a range of different operating points for which separate control maps may have been calibrated in the past. Accordingly, the complexity of initial calibration and set-up of an internal combustion engine may be reduced.

Furthermore, time invariant control maps known in the art are typically calibrated with relatively large safety margins in order to accommodate any changes in the internal combustion engine over time. By contrast, the map updating module according to the first aspect may update the actuator setpoints of the control maps in response to the changes in the real-time performance of the internal combustion engine. Thus, the control maps of the first aspect may be configured to cause the internal combustion engine to operate under more optimal performance conditions.

The initial actuator setpoint search space of the control maps may be a multidimensional search space defined by the possible range of actuator setpoints for each of the control maps. For example, an internal combustion engine controller may comprise three control maps for controlling actuators X, Y and Z of an internal combustion engine. Accordingly, the initial actuator setpoint search space is defined by the range of setpoint values for each of X, Y and Z for the control maps i.e. a three dimensional search space for the three actuators.

According to the first aspect, the map updating module updates the one or more hypersurfaces at the location defined by the plurality of input variables based on the optimised group of actuator setpoints. It will be appreciated that the step of updating the hypersurfaces may be based on the optimised group of actuator setpoints. As such, in some examples, the current location on one or more of the hypersurfaces may be more preferable than the location defined by the optimised group of actuator setpoints. So, in some examples, the step of updating may comprise the map updating module electing not to change the one or more of hypersurfaces of the control maps.

In some embodiments, the initial actuator setpoint search space may be defined by one or more of an upper actuator constraint and a lower actuator constraint. The upper actuator constraint and lower actuator constraint may be selected to ensure that the actuator of the internal combustion engine is operated within certain physical limits.

In some embodiments, one candidate group of actuator setpoints may correspond to the location on each hypersurface defined by the plurality of input variables. Thus, the internal combustion engine controller of the first aspect may always evaluate the current operating point of internal combustion engine (i.e. the current actuator setpoints) in the stratified sample of the initial actuator setpoint search space. Accordingly, the in the event that the current operating point of the internal combustion engine already corresponds to the global cost minimum, the optimiser module may return the current actuator setpoints (as determined by the location on each hypersurface defined by the plurality of input variables) as the optimised group of actuator setpoints.

In some embodiments, the search line in the actuator setpoint search space may be calculated based on the two candidate groups of actuator setpoints with the lowest cost. Accordingly, the optimiser module may determine a search line (i.e. a searching direction, or searching vector within the initial actuator setpoint search space) in a computationally efficient manner.

The map updating module may be further configured to determine a cost difference between the cost associated with the optimised group of actuator setpoints and the cost associated with the candidate group of actuator setpoints corresponding to the location on each hypersurfaces of the control maps defined by the plurality of input variables. If the cost difference is less than an update threshold, the hypersurfaces of the control maps are not updated. Accordingly, the internal combustion engine controller may elect to not update the control maps when only a trivial increase in performance may be obtained. For example, under steady state operation, it may not be desirable to be making frequent minor updates to actuator setpoints (thereby inducing wear in the actuators) for a relatively minor performance benefit.

In some embodiments, the optimiser module may be further configured to search for an optimised group of actuator setpoints by:

(iv) performing a stratified sample of a constrained actuator setpoint search space in order to select a second set of candidate groups of actuator setpoints, wherein the constrained actuator setpoint search space is constrained based on the optimised group of actuator setpoints, and evaluating the second set of candidate groups of actuator setpoints according to a performance model of the internal combustion engine to calculate a cost associated with each of the second set of candidate groups of actuator setpoints, (v) determining a further search line in the constrained actuator setpoint search space which spans a second cost minima based on the costs associated with the second set of candidate groups of actuator setpoints;

(vi) performing a line search along the further search line to calculate a group of actuator setpoints associated with the second cost minima;

(vii) updating the optimised group of actuator setpoints based on the group of actuator setpoints associated with the second cost minima if a cost reduction is achieved.

Accordingly, the map updating module the first aspect may iterate the optimised group of actuator setpoints calculated. By iterating the calculation, the optimiser module may identify a group of actuator setpoints corresponding more closely to the global cost minimum. In the event that the previously calculated optimised group of actuator setpoints falls within a local cost minima, the iterative searching strategy allows for the optimiser module to search around the optimised group of actuator setpoints (via the stratified sample) such that the global minimum may still be found.

The constrained actuator setpoint search space is an actuator setpoint search space similar to the initial actuator setpoint search space. Effectively, the constrained actuator setpoint search space is a subset of the initial actuator setpoint search space. That is to say, the range for each actuator setpoint to be searched may be constrained relative to the initial setpoint search space. The constrained actuator setpoint search space may be constrained based on the optimised group of actuator setpoints previously calculated (e.g. the first optimised group of actuator setpoints). The constrained actuator setpoint search space may be constrained by updating the upper actuator constraint and lower actuator constraint for each actuator used to define the actuator setpoint search space for the performing the stratified sample (e.g. the initial actuator setpoint search space, or a previous constrained actuator setpoint search space). In some embodiments, the available search range for each actuator may be reduced by at least: 30%, 40%, 50%, 60%, or 70%. In some embodiments, the upper actuator constraint and lower actuator constraint for each actuator may be selected such that the previously calculated optimised group of actuator setpoints is located towards the centre (i.e. as centrally as possible) of the constrained actuator setpoint search space.

By calculating a group of actuator setpoints associated with a second cost minima, the optimiser module allows for the possibility that the first cost minima is not the global minima for the performance model. Thus, the internal combustion engine controller according to the first aspect allows the optimised actuator setpoints calculated to be iterated.

In some embodiments the optimiser module is configured to repeat the steps of (iv), (v), (vi), and (vii) a plurality of times. As such, the optimiser module may iterate the calculation of the optimised group of setpoints a plurality of times. Repeating these steps may increase the certainty that the optimised group of actuator setpoints is located in a global cost minimum.

In some embodiments, the repeating of steps (iv), (v), (vi), and (vii) by the optimiser module may carry on until: the cost reduction achieved when updating the optimised group of actuator setpoints falls below a convergence limit, and/or a time taken to perform the search exceeds a time limit. Thus, the optimiser module may take into account the demand for computational resources and the likelihood/relative benefit of obtaining a further improvement to the optimised group of actuator setpoints calculated should a further iteration be performed.

In some embodiments, the stratified sample of the actuator setpoint search space is a Latin Hypercube sample of the initial actuator setpoint search space or the constrained actuator setpoint search space. By using a Latin Hypercube sample, the candidate groups of actuator setpoints selected may be evenly distributed across the search space. By distributing the candidate groups of actuator setpoints across the search space, the optimiser module aims to select at least one candidate group of actuator setpoints within the global cost minimum, in order to provide a robust algorithm for searching for an optimised group of actuator setpoints.

According to a second aspect of the disclosure a method of controlling an internal combustion engine may be provided. The method comprises providing a plurality of control maps, each control map defining a hypersurface of actuator setpoints for controlling an actuator of the internal combustion engine based on a plurality of input variables to the internal combustion engine controller, outputting an actuator setpoint to each actuator based on a location on the hypersurface of the respective control map defined by the plurality of input variables, and optimising one or more of the hypersurfaces of the control maps at the location defined by the plurality of input variables. Optimising one or more of the hypersurfaces of the control maps comprises: searching for an optimised group of actuator setpoints, and updating the one or more hypersurfaces at the location defined by the plurality of input variables based on the optimised group of actuator setpoints. Searching for an optimised group of actuator setpoints includes:

(i) performing a stratified sample of an initial actuator setpoint search space of the control maps in order to select a first set of candidate groups of actuator setpoints, and evaluating the first set of candidate groups of actuator setpoints according to a performance model of the internal combustion engine to calculate a cost associated with each of the first set of candidate groups of actuator setpoints, (ii) determining a search line in the initial actuator setpoint search space which spans a first cost minima based on the costs associated with the first set of candidate groups of actuator setpoints; and (iii) performing a line search along the search line to calculate an optimised group of actuator setpoints associated with the first cost minima.

Accordingly, the method of the second aspect may be implemented by an internal combustion engine controller according to the first aspect. Thus, it will be appreciated that the advantages described in relation to the first aspect may be applied to the method of the second aspect. Further, the optional features described in relation to the first aspect may equally apply to the second aspect of the disclosure.

BRIEF DESCRIPTION OF THE FIGURES

The invention will now be described in relation to the following non-limiting figures. Further advantages of the disclosure are apparent by reference to the detailed description when considered in conjunction with the figures in which.

DETAILED DESCRIPTION

Figure 1:
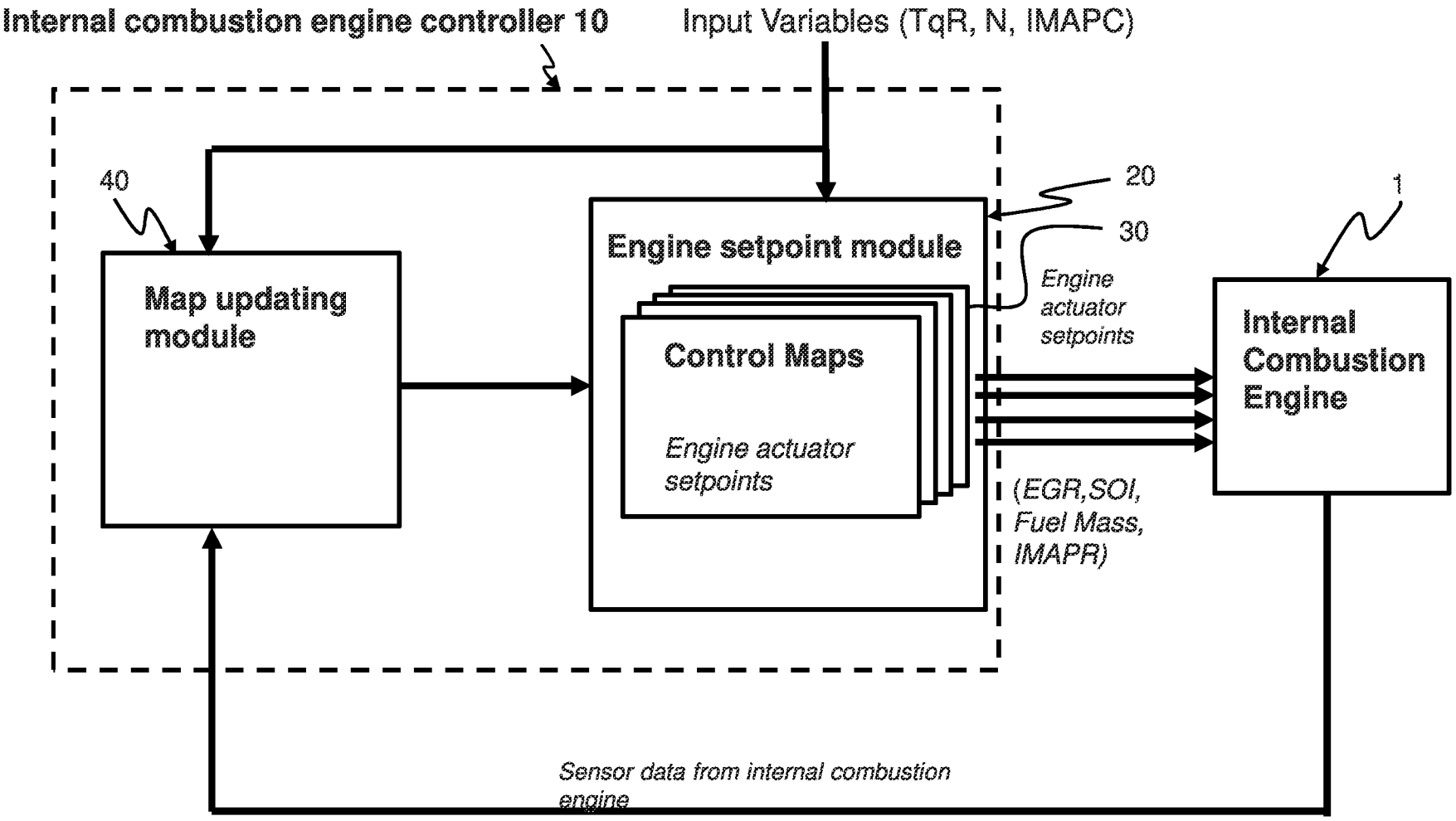
FIG. 1 shows a block diagram of an internal combustion engine controller connected to an internal combustion engine according to an embodiment of the disclosure.

A general system diagram of an internal combustion engine 1 and an internal combustion engine controller 10 according to an embodiment of this disclosure is shown in FIG. 1.

The internal combustion engine controller 10 may comprise a processor and a memory. As such, the internal combustion engine controller 10 may be implemented on any suitable computing device known in the art. The internal combustion engine module may be provided on a dedicated engine control unit (e.g. an engine control module) comprising one or more processors and integrated memory. The internal combustion engine controller 10 may be connected to a variety of inputs and outputs in order implement the control scheme of this disclosure. As such, the internal combustion engine controller 10 may be configured to receive various input variables signals, sensor data and any other signals that may be used in the control scheme. For example, the internal combustion engine controller 10 may be configured to receive engine sensor data such as Engine Speed, Barometric pressure, Ambient temperature, IMAP, Inlet Manifold Air Temperature (IMAT), EGR mass rate (or sensors used to derive an EGR mass estimate), Fuel rail pressure, and/or Air system valve positions, Fuel mass estimate, and/or aftertreatment sensor data such as Engine out NOx, Tailpipe NOx, Diesel particulate filter dP/RF soot sensor, Diesel oxidation catalyst inlet temperature, and/or SCR inlet temperature.

As indicated in FIG. 1, the actuators of the internal combustion engine are controlled by a plurality of engine actuator setpoints. The engine actuator setpoints are controlled the internal combustion engine controller 10. In the embodiment of FIG. 1, the engine actuators to be controlled are EGR, SOI, Fuel Mass, and Inlet Manifold Absolute Pressure Requested (IMAPR). Of course, in other embodiments, the engine actuators to be controlled may be varied.

As shown in FIG. 1, the internal combustion engine controller comprises an engine setpoint module 20. The engine setpoint module 20 is configured to output a control signal to each actuator based on the plurality of control maps 30 and the input variables to the engine setpoint module 20. As such, the operation of the engine setpoint module 20 is similar to the open loop, engine map based control schemes known in the prior art. Such open loop control schemes have relatively small computational requirements compared to more complex model-based control schemes.

The input variables to the engine setpoint module 20 may be a combination of different variables derived from the current operation of the internal combustion engine 1. Some of the input variables may be based on performance demands of the internal combustion engine. Some of the input variables may be based on the current operating state of the internal combustion engine 1, for example as measured by various sensors. As the input variables are used to determine an actuator setpoint based on a control map, it will be appreciated that the total number of input variables per control map may be restricted by the computational resources available to the internal combustion engine controller 10.

In the embodiment of FIG. 1, the input variables are requested torque (TqR), current engine speed (N), and current inlet manifold absolute pressure (IMAPC). In other embodiments, other input variables may be used such as current EGR (i.e. the current position of the EGR valve).

Each of the plurality of control maps 30 defines a relationship between one or more of the input variables and an actuator setpoint. In the embodiment of FIG. 1, four control maps 30 are provided, one for controlling each of EGR, SOI, Fuel Mass, and IMAPR. Each of the control maps 30 may define an engine actuator setpoint based on one or more of the input variables TqR, N and IMAPC. For example, in one embodiment the EGR control map may define a hypersurface of actuator setpoints based on the TqR, N, and IMAPC. As such, a combination of TqR, N and IMAPC defines a location of the hypersurface from which an actuator setpoint for EGR can be calculated. Similarly, the control maps 30 for SOI and Fuel Mass may also be defined by a hypersurface which is a function of TqR, N, and IMAPC. The control map for IMAPR in the embodiment of FIG. 1 may be defined by a hypersurface which is a function of TqR and N. As such, different control maps of the plurality of control maps 30 may have a different number of dimensions (i.e. a different number of input variables).

Figures 2A, 2B:
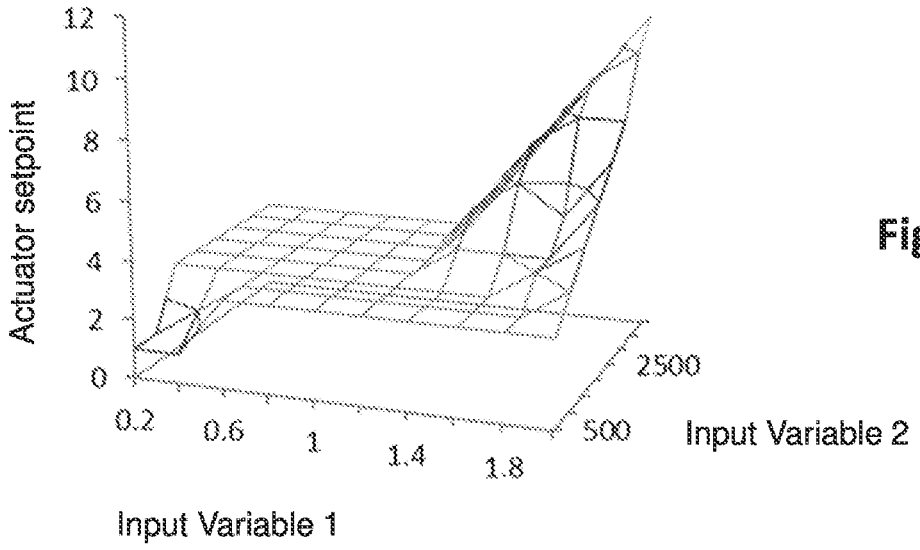
FIG. 2*a* shows an example of a look-up table control map according to an embodiment of this disclosure.
FIG. 2*b* is a graphical representation of the hypersurface defined by the example look-up table control map of FIG. 2*a*.

Each of the control maps 30 of FIG. 1 may be implemented as a look-up table. Look-up table control maps 30 for engine controllers are well known in the art. An exemplary look-up table control map 31 is shown in FIG. 2*a*. The look-up table control map 31 shown in FIG. 2*a* has two input dimensions and a single output dimension. Accordingly, in the embodiment of FIG. 2*a*, the control map 31 is a two-dimensional control map, wherein the number of dimensions recited is determined by the number of input dimensions. The control map 31 of FIG. 2*a* comprises input variable 1 (i.e. a first input variable) and input variable 2 (a second input variable). The look-up table defines a plurality of values (actuator setpoints) for different combinations of input variable 1 and input variable 2. As such, the lookup table control map 31 may be used to select an actuator setpoint based on the values of input variables 1 and 2. FIG. 2*b* is a graphical representation of the hypersurface defined by the values in the look-up table control map 31. As is known in the art, interpolation of the setpoints defined in the look-up table may be used to find a location on the hypersurface where one or more of the input variables do not exactly match the values stored in the look-up table.

In other embodiments, alternative means may be used to describe the hypersurface for each control map 30. For example, the hypersurface may be defined as a function of the input variables. Suitable multidimensional functions for defining a hypersurface may be a universal approximator function. Suitable universal approximator functions may include: artificial neural networks (e.g. radial basis functions, multilayer perceptrons), multivariate polynomials, fuzzy logic, irregular interpolation, kringing).

The plurality of control maps 30 may be stored in the memory of the internal combustion engine controller 10 such that the various processing modules of the internal combustion engine controller 10 can access the control maps 30.

As shown in FIG. 1, the internal combustion engine controller 10 also includes a map updating module 40. The map updating module 40 is configured to optimise one or more of the hypersurfaces of the control maps at the location defined by the plurality of input variables. In the embodiment of FIG. 1, the map updating module 40 calculates an optimised hypersurface for each of the control maps 30 concurrently. The map updating module 40 updates the control maps at the location defined by the plurality of input variables.

The map updating module 40 is configured to update the hypersurface of a control map 30 based on the optimised hypersurface. Accordingly, the hypersurface for one or more control maps 30 may be updated during operation of the internal combustion engine 1. By providing a set of updatable control maps 30, a set of control maps 30 may be provided which can be optimised to a range of different operating points. Thus, the number of control maps that need to be calibrated for an internal combustion engine 1 may be reduced, as the set of updatable control maps 30 of this disclosure may provide control covering a range of different operating points for which separate sets of control maps (i.e. multiple sets of control maps) may have been calibrated in the past.

Figure 3:
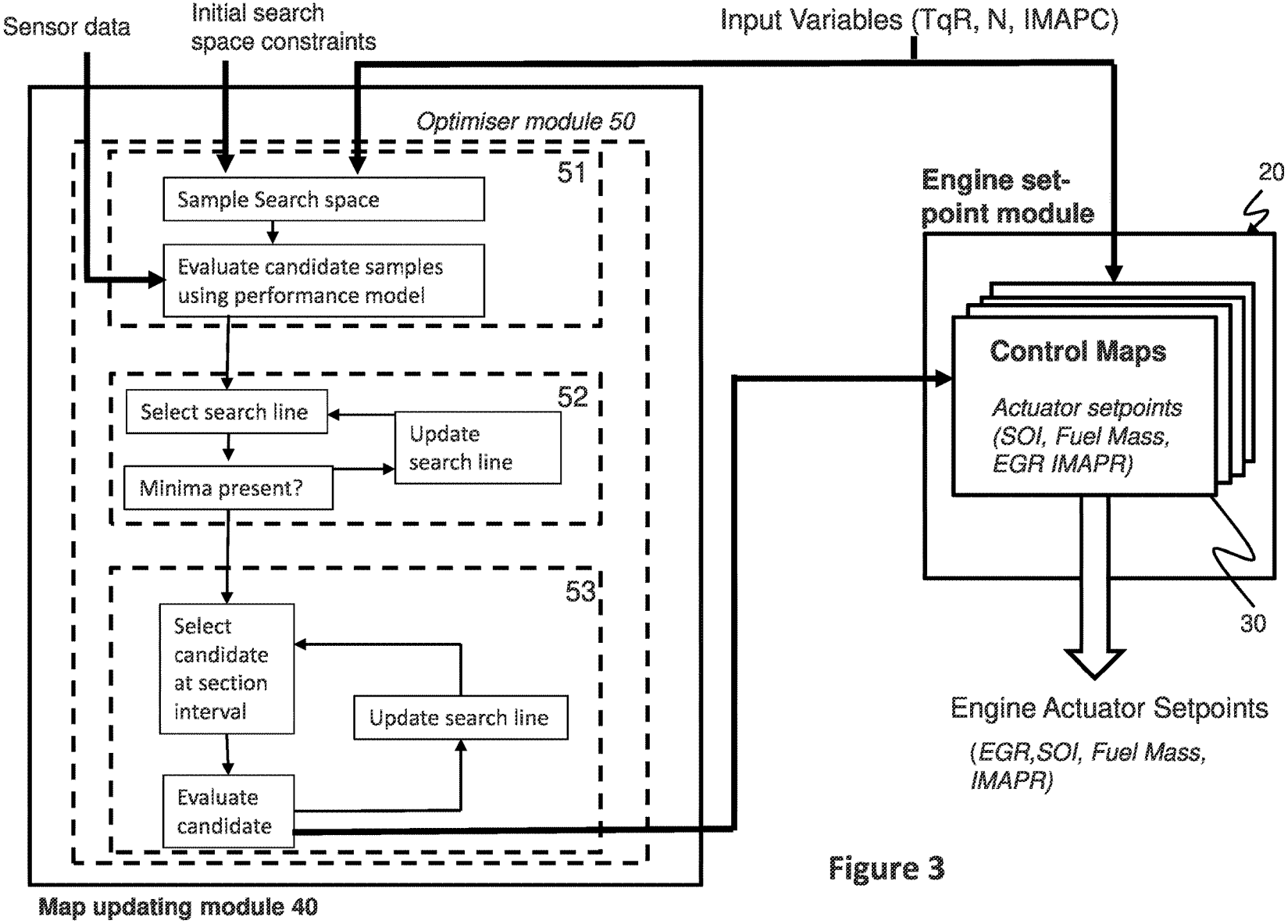
FIG. 3 shows a block diagram of part of an internal combustion engine controller according to an embodiment of the disclosure.

FIG. 3 shows a block diagram representative of an internal combustion engine controller according to an embodiment of the disclosure. The block diagram indicates the engine setpoint module 20 and the map updating module 40. As such, the internal combustion engine controller of this embodiment has a similar general structure to the structure of the internal combustion engine controller 10 shown in FIG. 1. Thus, with reference to FIG. 1 and the corresponding description, it will be understood that the engine setpoint module 20 operates to output a plurality of actuator setpoints based on locations on hypersurfaces of respective control maps 30 defined by the plurality of input variables.

As indicated in FIG. 3, the map updating module 40 comprises an optimiser module 50 configured to search for an optimised group of actuator setpoints. The process of searching for an optimised group of actuator setpoints comprises carried out by the optimiser may be considered to be separated into three sub-modules 51, 52, 53. In the first sub-module 51, the optimiser module performs a stratified sample of an initial actuator setpoint search space of the control maps in order to select a first set of candidate groups of actuator setpoints, and evaluates the first set of candidate groups of actuator setpoints according to a performance model of the internal combustion engine to calculate a cost associated with each of the first set of candidate groups of actuator setpoints. In the second sub-module 52, the optimiser module 50 determines a search line in the initial actuator setpoint search space which spans a first cost minima based on the costs associated with the first set of candidate groups of actuator setpoints. In the third sub-module 53, the optimiser module 50 performs a line search along the search line to calculate an optimised group of actuator setpoints associated with the first cost minima. The three step process of searching for an optimised group of actuator setpoints is indicated by the sub-modules 51, 52, and 53 shown in the block diagram of FIG. 3.

The first sub-module 51 performs a stratified sample of an initial actuator setpoint search space of the control maps. The initial actuator setpoint search space may be a multidimensional search space, wherein the number of dimensions corresponds to the number of control maps (i.e. the number of actuators of the internal combustion engine to be controlled by the internal combustion engine controller). Each actuator of the internal combustion engine may have a predetermined range of actuator setpoints. The predetermined range of actuator setpoints for a control map may be defined by one or more of an upper actuator constraint and a lower actuator constraint. The upper actuator constraint and lower actuator constraint may be selected to ensure that the actuator of the internal combustion engine is always operated within certain physical limits. For example, for the EGR actuator, an upper EGR actuator constraint may be 360 kg/hr and a lower EGR actuator constraint may be 0 kg/hr. Accordingly, an initial actuator setpoint search space may be defined by an upper actuator constraint and lower actuator constraint for each control map of the internal combustion engine controller. As explained above, the initial actuator setpoint search space may be predetermined to reflect the physical limits of the actuators of the internal combustion engine. The upper actuator constraint and lower actuator constraint for each control map defining the initial actuator setpoint search space may be stored in the memory of the internal combustion engine controller.

In some embodiments, the initial actuator setpoints search space may be varied according to a desired operating point for the internal combustion engine. For example, the search space for the EGR actuator may be varied according to a desired operating load and/or desired engine speed of the internal combustion engine. For example, the upper actuator constraint may be varied according to a desired operating point. In one embodiment, the upper EGR actuator constraint may be varied according to a desired load and/or engine speed of the internal combustion engine. For example, an upper EGR actuator constraint of 360 kg/hr may be provided at high speed high load. At low speed and low load, it may be desirable to reduce EGR, and so the upper EGR actuator constraint may be lowered, or even set to 0 kg/hr to "clamp" the optimiser with respect to this variable.

The initial actuator setpoint search space effectively defines every possible operating point that may be evaluated by internal combustion engine controller. The optimiser module 50 is configured to select candidate groups of actuator setpoints from within the initial actuator setpoint search space for evaluation by the optimiser module 50. Each candidate group of actuator setpoints effectively represents a potential operating point for the internal combustion engine 1. As part of the first step, the optimiser module 50 is configured to perform a stratified sample of the initial actuator setpoint search space in order to obtain a first set of candidate groups of actuator setpoints. By sampling the initial actuator setpoint search space using a stratified sample, the optimiser module ensures that the candidate groups of actuator setpoints selected are distributed across the actuator setpoint search space. As such, it will be appreciated that a stratified sample may provide a more even distribution of candidate groups of actuator setpoints across the initial actuator setpoint search space than a purely random sample of the initial actuator setpoint search space.

Various methods of performing a stratified sample of a multidimensional search space are known to the skilled person. In one embodiment of the disclosure, the optimiser module 50 performs a Latin hypercube sample of the initial actuator setpoint search space. Thus, for an initial actuator setpoint search space of N variables, the range of each actuator (as defined by the upper and lower actuator constraints) is divided into M equally probable intervals. M sample points are then placed wherein each sample point is the only one in each axis-aligned hyperplane. For example, at least 5 sample points are taken, or at least 7, or at least 9. In other embodiments, an orthogonal sampling method may be used to determine a stratified sample, or any other suitable stratified sampling method which provides a distribution of candidate groups of actuator setpoints across the initial actuator setpoint search space.

The first sub-module 51 evaluates each candidate group of actuator setpoints (of the first set) according to a performance model of the internal combustion engine. The first sub-module 51 uses the performance model to calculate a cost associated with each candidate group of actuator setpoints of the first set.

Figure 4:
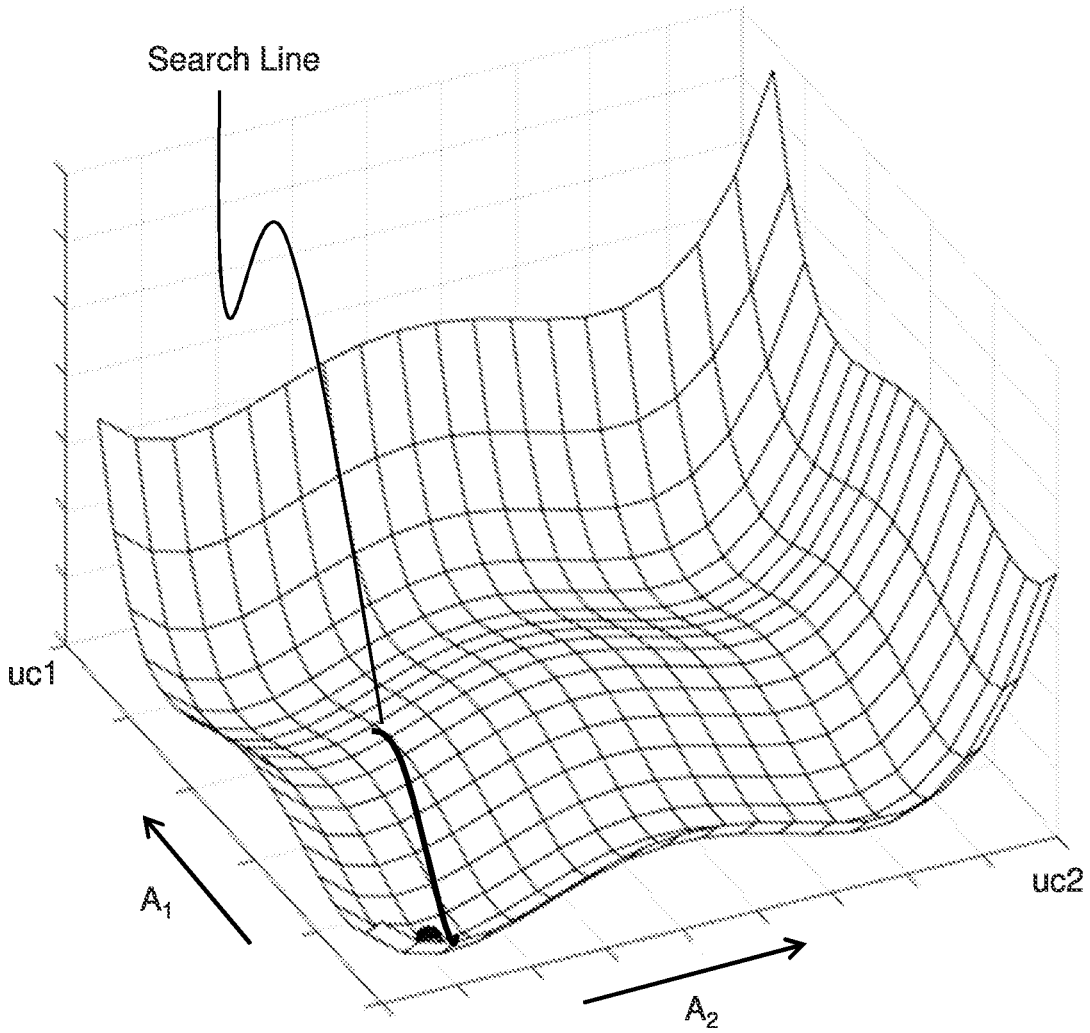
FIG. 4 shows a graphical representation of part of an initial actuator setpoint search space and a performance model according to an embodiment of this disclosure.
Figure 5:
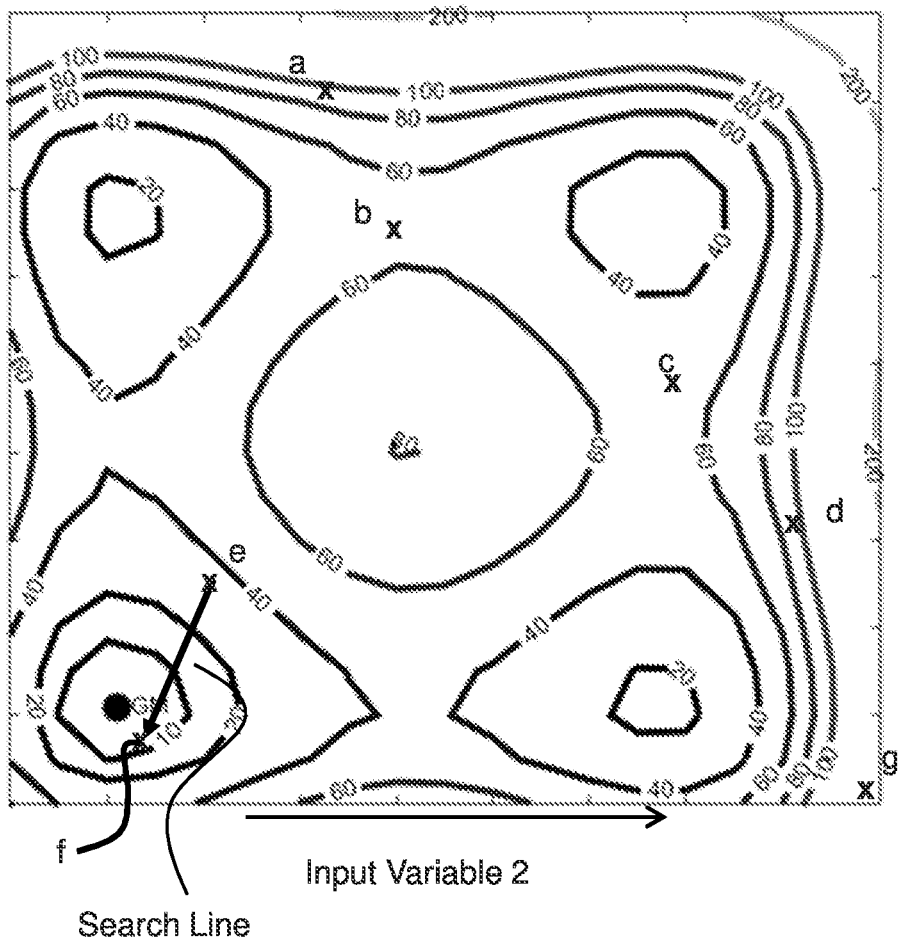
FIG. 5 shows a contour plot representation of the performance model of FIG. 4 including points representing candidate groups of actuator setpoints selected according to a stratified sample.

FIG. 4 shows a graphical representation of part of an initial actuator setpoint search space and a cost surface generated by a performance model according to an embodiment of this disclosure. In the embodiment of FIG. 4, the initial actuator setpoint search space is defined by two actuator variables $A_1$ and $A_2$ (i.e. a two dimensional initial actuator setpoint search space). Thus, as shown in FIG. 4, the performance model defines a surface of costs in the initial actuator setpoint search space. A further contour plot view of the cost surface of FIG. 4 is shown in FIG. 5. As noted above, only a portion of the initial actuator setpoint search space is shown. Each actuator variable ($A_1$ and $A_2$) has a search range from a lower constraint limit (Ic1 and Ic2 respectively, not shown in FIGS. 4 and 5) to an upper constraint limit (uc1 and uc2 respectively). FIGS. 4 and 5 shows the initial actuator setpoint search space from an intermediate value of $A_1$ and $A_2$ up to uc1 and uc2 respectively. It will be appreciated that the cost surface shown in FIGS. 4 and 5 is only one illustrative example of a possible actuator setpoint search space and resulting cost surface, in other embodiments, actuator setpoint search spaces with three or more dimensions are contemplated.

A series of points a, b, c, d, e, f, and g are indicated in FIGS. 4 and 5 to represent the first set of candidate groups of actuator setpoints selected by the first sub-module 51. The points a, b, c, d, e, f, and g represent a stratified sample (Latin hypercube sample) of the initial actuator setpoint search space.

The performance model used to evaluate each candidate group of actuator setpoints may be any suitable performance model for evaluating the performance of an internal combustion engine. The performance model may depend on the input variables and processing power available to the optimiser module 50. The performance model of the internal combustion engine may be real-time performance model of the internal combustion engine 1. By real-time performance model, it is understood that the evaluation is based on a model of the performance internal combustion engine which is calculated in real time, rather than, for example, an off-line calculation of historic engine data. The real-time performance model may use sensor data from the internal combustion engine 1 and the plurality of input variables (i.e. real-time input variables to the internal combustion engine). As such, the real-time performance model may use additional sensor data from the internal combustion engine 1, in addition to the input variables to the control maps in order to optimise the control maps. Effectively, the internal combustion engine controller 10 of this disclosure may incorporate additional variables (direct and/or indirect sensor data variables) into the control of the internal combustion engine in manner which does not significantly increase the computational complexity of the map based control.

The performance model of the internal combustion engine 1 may comprise an engine model arranged to calculate one or more engine performance variables, and a cost model arranged to calculate a cost based on the one or more engine performance variables. The engine model may utilise one or more physical models of the internal combustion engine to calculate engine performance variables, and/or one or more empirical models arranged to calculate further engine performance variables. As such, the performance model of the internal combustion engine 1 may be a "grey box" type performance model.

The inputs to the performance model may be the plurality of input variables of the control maps, as well as sensor inputs from the internal combustion engine, and the candidate group of actuator setpoints. As such, the performance model is provided with a plurality of variables associated with the real-time operation of the internal combustion engine.

Accordingly, the engine performance variables calculated by the performance model may be representative of the real-time performance of the internal combustion engine 1.

One example of a suitable performance model is now described with reference to FIG. 3. In the embodiment of FIG. 3 the performance model is provided with a candidate group of actuator setpoints for SOI, Fuel mass, EGR Requested (EGR), and IMAPR. The performance model is also provided with a plurality of real-time data from sensors of the internal combustion engine. Sensor data from the internal combustion engine 1 may include information from various sensors associated with the internal combustion engine. Sensor data may also include various variables derived from data from one or more sensors of the internal combustion engine. For example the sensor data may include inlet manifold pressure, inlet manifold temperature, fuel rail pressure, back pressure valve position, mass EGR flow, mass total air flow, fuel mass flow, fuel rail pressure (FRP).

The performance model may include one or more models configured to calculate a plurality of engine performance variables associated with each candidate group of actuator setpoints. It will be appreciated that as the inputs to the performance model include the actuator setpoints for the internal combustion engine and the sensor data, the engine performance variables calculated will be representative of a real-time performance of the internal combustion engine 1 under those actuator setpoints. The engine performance variables calculated may include: engine torque, mass airflow, brake mean effective pressure (BMEP), net indicated mean effective pressure (IMEP), pumping mean effective pressure (PMEP), friction mean effective pressure (FMEP), exhaust manifold temperature, peak cylinder pressure, NOx quantity (e.g. Net Indicated Specific NOx, Brake Indicated Specific NOx) Soot quantity (e.g. Net Indicated Specific Soot, Brake Indicated Specific Soot), NOx/Soot ratio, minimum fresh charge, EGR potential. The physical relationships between the above engine performance variables and the inputs provided to the performance model are well known to the skilled person. As discussed above, the performance model may utilise physics-based models, empirical models or a combination of empirical and physics based models (i.e. semi physical/grey box models) to calculate one or more of the above engine performance variables.

For example, the performance model may include a mean value engine model. Mean value engine models are well known to the skilled person for modelling engine performance parameters such as BMEP, engine torque, mass airflow etc. Further explanation of a mean value engine model suitable for use in the present disclosure may be found "Event-Based Mean-Value Modeling of DI Diesel Engines for Controller Design" by Urs Christen et al, SAE Technical Paper Series. Thus, the performance model may be used to calculate engine performance variables based on the inputs.

In addition to the use of a mean value model, the performance model may include one or more neural network based models for calculating one or more engine performance variables. For example, a Net Indicated Specific NOx (NISNOx) engine performance variable may be calculated from the sensor data using a suitably trained neural network. Further explanation of suitable techniques for calculating engine performance variable such as NISNOx using a neural network may be found in "Development of PEMS Models for Predicting NOx Emissions from Large Bore Natural Gas Engines" by Michele Steyskal et al, SAE Technical paper series.

In addition to the above models, physics-based models of one or more internal combustion engine components may be provided. For example, a compressor model, a turbine model, or an exhaust gas recirculation cooler model may be provided in order to help calculate suitable engine performance variables.

The performance model outputs the engine performance variables to a cost model. The cost model is configured to evaluate the one or more engine performance variables and output a cost associated with each candidate group of actuator setpoints based on the engine performance variable(s).

The cost model may comprise a plurality of functions configured to assign a cost to various performance targets in order to evaluate the performance of the internal combustion engine 1 according to the candidate group of actuator setpoints. For example, the plurality of functions may comprise one or more performance objective functions, one or more emissions functions, and one or more engine constraint functions. Each of the plurality of functions may be configured to output a cost based on a function of one or more of the engine performance variables and one or more cost parameters. The cost parameters determine the magnitude of the cost associated with each engine performance parameter. In the embodiment of FIG. 3, the cost functions are configured such that a lower cost is associated with a more optimal performance.

Figure 6A:
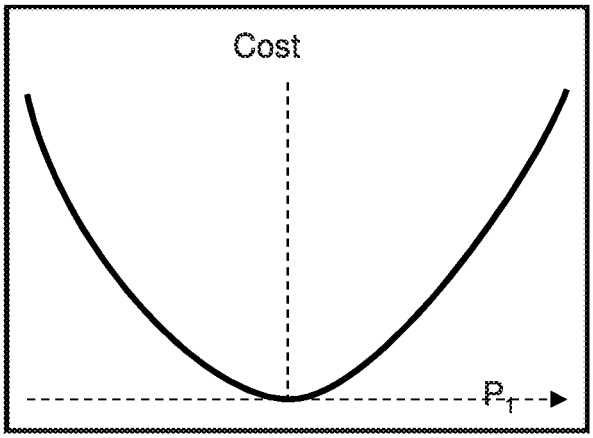
FIGS. 6*a*, 6*b* and 6*c* show graphical representations of suitable functions for a performance objection function, an emissions function, and an engine constraint function respectively.

A performance objective function may be a function configured to optimise the internal combustion engine 1 to meet certain performance objectives. For example, performance objective may be to minimise Brake Specific Fuel Consumption (BSFC) or Net Indicate Specific Fuel Consumption (NISFC). A further performance objective may be to minimise torque error (i.e. the difference between the actual output torque and the torque requested). Such forms of performance objective function may be represented by a function having a weighted square law relationship (i.e. of the form: Cost=Weight*(engine performance variable)^2). As such, for a performance objective function, a weight of the performance objective function is a cost parameter. A graphical representation of a suitable performance objective function is shown in FIG. 6*a*. For example, a performance objective for NISFC ($Cost_{NISFC}$) may be:

$$Cost_{NISFC}=Weight_{NISFC}*NISFC\hat{}2$$

Figure 6B:
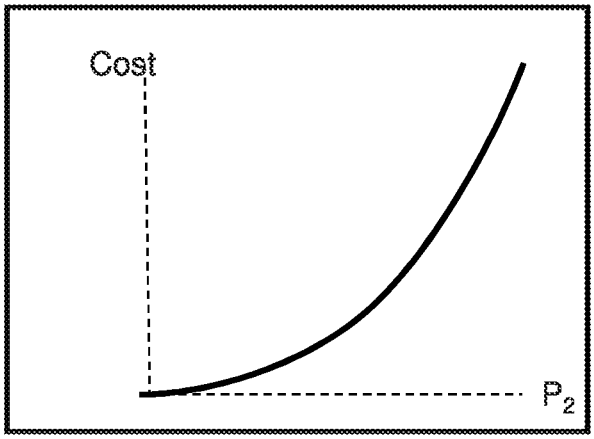

An emission function may be a function configured to optimise the internal combustion engine in order to meet certain objectives in relation to the emissions produced by the internal combustion engine. For example one or more emissions function may be provided based on engine performance variables relating to emissions produced by the internal combustion engine. As such, one or more emissions functions may be based on NOx quantity (NISNOx, Soot (NISCF), NOx Soot ratio, minimum fresh charge, and/or EGR potential. The emissions functions may define a relationship between a cost and the engine performance variables using any suitable function. For example, in the embodiment of FIG. 3, the emissions functions may be provided as one sided square law functions. A graphical representation of a suitable emissions function is shown in FIG. 6*b*.

In this disclosure, Net indicated specific NOx (NISNOx) is intended to refer to the NOx quantity output by the internal combustion engine, prior to any treatment in an aftertreatment system. Of course, the skilled person will appreciate that the NOx quantity may also be estimated downstream of the aftertreatment system (e.g. tailpipe NOx).

For example, an emissions function may include a target upper limit (T). The target upper limit may define a value for an engine performance variable above which the cost incurred becomes significant, whereas for values below the target upper limit, no cost, or minimal cost is incurred. For example, for some internal combustion engines, a target upper limit for NISNOx may be 4 g/kWh. Thus, for an emissions function a target upper limit, and/or a weight may be a cost parameter. In other embodiments, a target limit may be provided as a target lower limit.

Accordingly, an emissions function ($Cost_{NOx}$) based on the engine performance variable NISNOx may be:

$$\text{When: } NISNOx<T, Cost_{NOx}=0$$

$$NISNOx \geq T, Cost_{NOx}=Weight_{NOx}*(NISNOx-T)\hat{}2$$

Figure 6C:
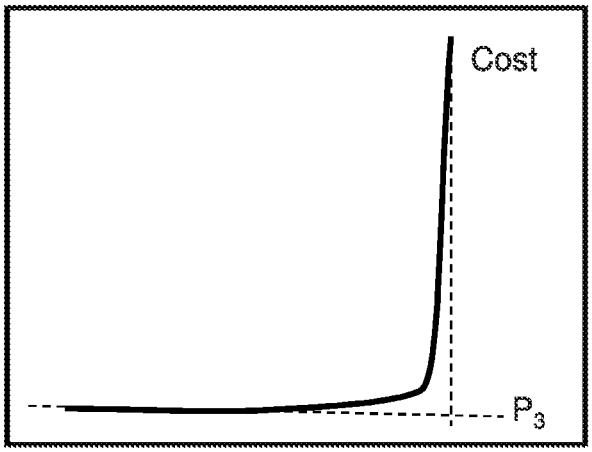

An engine constraint function may be a function configured to reflect constraints associated with the performance of the internal combustion engine. As such, the one or more engine constraint functions may be provided to discourage or prevent the internal combustion engine controller from operating the internal combustion engine 1 under certain operating conditions. For example, one or more engine constraint functions may be based on engine performance variables which have fixed limits which cannot be exceeded due to physical requirements of the internal combustion engine. As such, one or more engine constraint functions may be based on peak cylinder pressure (PCP), exhaust manifold temperature, compressor outlet temperature. Further engine performance variables which may have desirable fixed limits such as max torque error may also have a corresponding engine constraint function. Each engine constraint function may define a relationship between a cost and one or more of the engine performance variables using any suitable function. For example, in the embodiment of FIG. 3, the engine constraint functions may be provided in the form Cost=1/engine performance variable(s). A graphical representation of a suitable engine constraint function is shown in FIG. 6*c*.

For example, an engine constraint function for the engine performance variable PCP may be provided based on a limit L. The cost calculated by the engine constraint function may rise asymptotically as the limit L is approached. Thus, a limit L may also be a cost parameter. Accordingly, an engine constraint function ($Cost_{PCP}$) based on the engine performance variable PCP may be:

$$Cost_{PCP}=1/(L-PCP)$$

As described above, various cost parameters have been described with respect to performance objective functions, emissions functions, and engine constraint functions. The cost parameters may be stored by the cost model, for example as a cost parameter vector. In some embodiments, the cost parameters may be time varying. That is to say, in some embodiments the cost model may update one or more of the cost parameters in order to effect a change in the relative costs associated with different engine performance variables. For example, the cost model may update one or more cost parameters in order to initiate regeneration of the aftertreatment system as described below.

For example, the cost model may utilise data from the aftertreatment system in order to determine that a regeneration of the aftertreatment system is to be performed (e.g. an indication from the aftertreatment system that regeneration of a Diesel Particulate Filter is required). The cost model may update some of the costs functions of the model in order to effect a regeneration of the aftertreatment system. For example, a cost function (e.g. a performance objective function) may be provided to control an exhaust minimum temperature. To regenerate the aftertreatment system, the exhaust temperature minimum penalty may be increased (e.g. to 400° C.) to encourage the optimiser to calculate an optimised hypersurface which increases exhaust temperature. The internal combustion engine may not be able to reach such an exhaust temperature, but will be encouraged to find a solution that minimises the deviation from this value. When aftertreatment thermal management is not required, the exhaust temperature minimum penalty may be set to a negligible value (e.g. −180° C.). Thus when not required, the cost function will not consider this term.

Thus, the cost model may calculate a total cost associated with each candidate group of actuator setpoints based on the costs calculated by each of the cost functions calculated above. The total cost associated with each candidate group of actuator setpoints may be provided to the optimiser module 50 for further processing.

Accordingly, a performance model for calculating a cost associated with each candidate group of actuator setpoints may be provided. It will be appreciated that various modifications or variations to the above performance model may be contemplated by the skilled person. In particular, the performance model may be adapted based on the specific internal combustion engine 1 the internal combustion engine controller 10 is intended to control.

In the second step, the second sub-module 52 of the optimiser module 50 determines a search line in the initial actuator setpoint search space which spans a first cost minima based on the costs associated with the first set of candidate groups of actuator setpoints.

In one embodiment, the search line is determined based on the two candidate groups of actuator setpoints with the lowest costs. For example, as indicated in the search space of FIGS. 4 and 5, a search vector is determined as a vector in the initial actuator setpoint search space along the line between the two candidate groups of actuator setpoints with the lowest costs. The value of the cost function along the search vector is represented graphically in FIG. 7. The purpose of determining a search vector is to provide a direction along which to further search for a minima in order to identify an optimised group of actuator setpoints.

Figure 7:
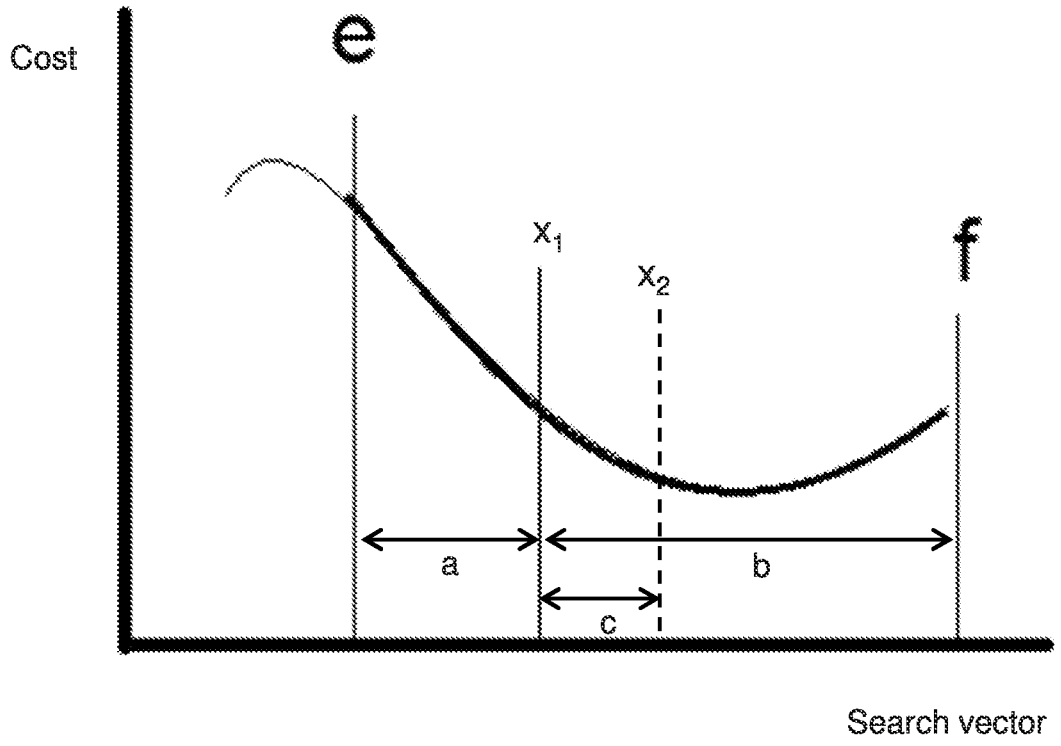
FIG. 7 shows a graphical representation of cost function along search line shown in FIGS. 4 and 5.

Once the search vector is determined, the sub-module 52 determines a line along the search vector which straddles a cost minimum. Various methods for determining if a minima of a function (i.e. the performance model) lies between two points on a line are known to the skilled person. One example for determining a search line is discussed in more detail below. Once a search line is determined along which a minima is known to lie, the sub-module 52 outputs information defining the search line to the third sub-module 53. It will be appreciated that the search line can be defined in various ways, e.g. as co-ordinates (i.e. two candidate groups of actuator setpoints), or as an equation. FIG. 7 shows in bold the search line extending between points e and f.

One method for checking if a minima lies along a search line is to evaluate the cost function at a third point ($x_1$) along the search line (i.e. between the two candidate groups of actuator setpoints defining the start and end of the search line). If the third point evaluated has a cost which is lower than either of the two end points of the search line, this indicates that a minima lies on the search line between the two end points. In the event that it is determined that a minima is not present along the search line, the end points of the search line may be extended along the search vector in the initial actuator setpoint search space and re-evaluated. This process may be iterated until a search line straddling a minima (e.g. as shown in FIGS. 4 and 5) is found. One advantage of this method is that the number of candidate groups of actuator setpoints which need to be evaluated may be reduced. That is to say, it is not required to evaluate every point along the search vector. In many cases, the candidate groups of actuator setpoints with the lowest cost identified by the stratified search will straddle a minimum, and so only one further point along the search line (i.e. one further candidate group of actuator setpoints) is evaluated to confirm a minima lies on the line. For example, as indicated in the example of FIG. 5, the cost of the performance model along the search line is minimised at a point between candidate groups e and f.

In the third step, the third sub-module 53 of the optimiser module 50 performs a line search along the search line to calculate an optimised group of actuator setpoints associated with the first cost minima. As such, the line search aims to identify the point along the search line in the initial actuator setpoint search space corresponding to the cost minima. Various line searching methods are known to the skilled person for searching for minima of a function along a line.

With reference to the search line of FIG. 7, a golden-section line search method may be used to locate the minima. A golden-section line search is a form of sectioning algorithm wherein the golden ratio ($(1+\sqrt{5})/2$) is used to select the next point (group of actuator setpoints) to be evaluated. Other sectioning algorithms (e.g. bisection) may also be suitable. One advantage of a golden-section line search is that the previously identified candidate groups of actuator setpoints can be re-used in the algorithm, thereby reducing the computational requirement of the optimiser module 50. The golden-section algorithm uses three points on a curve, wherein the minimum is believed to lie between the three points.

In the embodiment of FIG. 7, the point $x_1$ may be selected between the end points of the search line using the golden ratio. As shown in FIG. 7, the next candidate group of actuator setpoints to be evaluated (represented by point $x_2$) can be selected based on the two points used to establish the search line, and the point $x_1$ used to confirm that the search line straddles a minimum. The point $x_2$ is selected on the search line such that the distance b is equal to a+c. Depending on the value of the cost at point $x_2$, the golden section algorithm updates the three points defining the cost minimum. For example, in the embodiment of FIG. 7, the next triplet of points would be $x_1$, $x_2$, and f.

The golden-section line search may iterate the search until the minima along the search line is identified. The golden-section line search may be terminated once a termination criterion is reached. The termination criteria may be based on one more of: a maximum number of iterations, and a reduction in the cost between two iterations falling below a certain threshold (i.e. the search has converged on an optimised group of actuator setpoints).

Once the optimiser module has identified an optimised group of actuator setpoints, the map updating module 40 updates the one or more hypersurfaces of the control maps 30 based on the optimised group of actuator setpoints. The hypersurfaces are updated at the location on each control hypersurface defined by the plurality of input variables, as these are the input variables used to evaluate the cost associated with the candidate groups of actuator setpoints. The hypersurface for each control map may be updated to reflect the actuator setpoints in the optimised group of actuator setpoints at the location on each control hypersurface defined by the plurality of input variables. As such, the map updating module 40 may update the real-time operating point of the internal combustion engine 1 defined by the control maps.

The map updating module 40 may include a further check to determine whether or not to update the control maps based on the optimised group of actuator setpoints. The map updating module 40 may determine a cost difference between the cost associated with the optimised group of actuator setpoints and the cost associated with the candidate group of actuator setpoints corresponding to the location on each hypersurfaces of the control maps defined by the plurality of input variables. If the cost difference is less than an update threshold, the hypersurfaces of the control maps may not be updated. It will be appreciated that for some optimised groups of actuator setpoints, the improvement in performance relative to the current actuator setpoints defined by the locations on the hypersurfaces of the control maps may be relatively small. For some internal combustion engines 1, it may not be desirable to make frequent changes to the actuator setpoints for relatively modest improvements in performance. Thus, where the cost reduction associated with a change in the actuator settings to the optimised setpoints is less than a predetermined threshold, the map updating module may elect not to update the control maps 30. For example, the predetermined threshold may be percentage of the previous cost. That is to say, where the change is less than: 10%, 5%, 3% or 1% difference, the map updating module 40 may not update the control maps 30.

Figure 8:
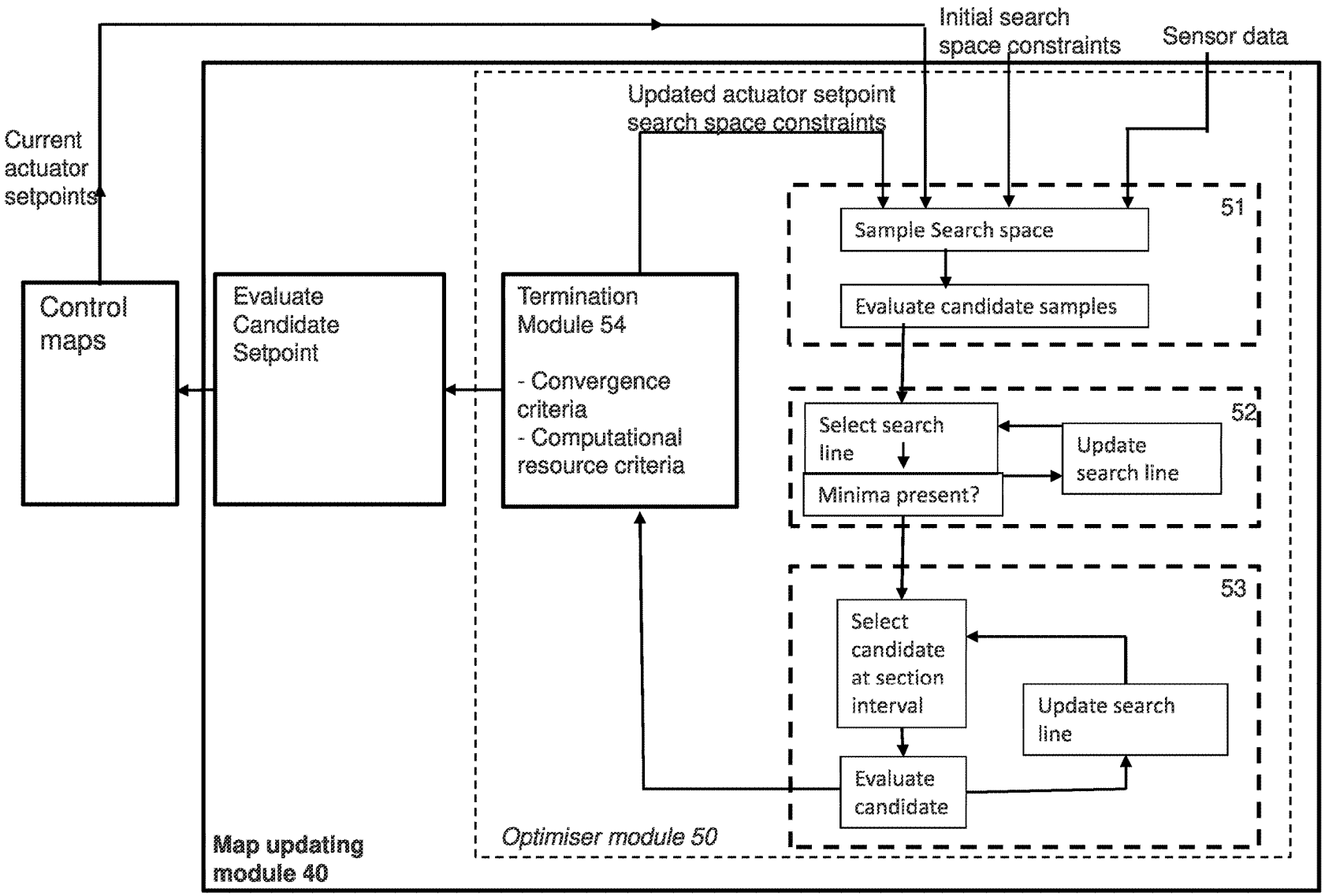
FIG. 8 shows a block diagram of diagram of part of an internal combustion engine controller according to a further embodiment of the disclosure.

According to a further embodiment of the disclosure, the optimiser module may be configured to iterate the process for calculating the optimised group of actuator setpoints. FIG. 8 is a block diagram of a further embodiment of the disclosure in which the optimiser iterates the calculation of the optimised group of actuator setpoints.

As shown in FIG. 8, the optimiser module 50 may be further modified to incorporate an input from the control maps 30. The optimiser module 50 may be configured to select one candidate group of actuator setpoints based on the control signal output of the engine setpoint module 20. As such, the current control signal output by the internal combustion engine controller 10 may be provided to the map updating module 40 in order to be evaluated as one of the candidate groups of actuator setpoints. Accordingly, the map updating module 40 may evaluate locations on the current hypersurfaces defined by the control maps 30 when calculating the group of optimised actuator setpoints.

As will be appreciated by the skilled person, the output of the engine setpoint module 20 may be based on control maps 30 which have previously been updated by the map updating module 40. Thus, the candidate group of actuator setpoints based on the control signal output of the engine setpoint module 20 may reflect a previously calculated optimised hypersurface. As such, the internal combustion engine controller 10 may effectively incorporate a form of memory in which previously calculated optimised hypersurfaces may influence the candidate groups of actuator setpoints evaluated by the optimiser module 50.

Similar to the embodiment of FIG. 3 discussed above, the optimiser module 50 of FIG. 8 is arranged to perform a stratified sample of an initial actuator setpoint search space and calculate a (first) optimised group of actuator setpoints. The optimiser module 50 may calculate the first optimised group of actuator setpoints substantially as discussed above for the embodiment of FIG. 3.

Once the first optimised actuator setpoints have are calculated, the optimiser module may elect to iterate the solution found by repeating the search process described above. In order to try to improve the optimised actuator setpoints, the optimiser module repeats the search process using an updated search space. As such, rather than performing a stratified sample of the initial actuator setpoint search space, the optimiser module performs a stratified sample of a constrained actuator setpoint search space (i.e. a subset of the initial actuator setpoint search space).

The constrained actuator setpoint search space may be constrained based on the optimised group of actuator setpoints previously calculated (e.g. the first optimised group of actuator setpoints). The search space may be constrained by updating the upper actuator constraint and lower actuator constraint for each actuator used to define the search space for the performing the stratified sample (e.g. the initial actuator setpoint search space). The available search range for each actuator may be reduced by at least: 30%, 40%, 50%, 60%, or 70%. The upper actuator constraint and lower actuator constraint for each actuator may be selected such that the previously calculated optimised group of actuator setpoints is located in the centre of the constrained actuator setpoint search space. Of course, in some examples, it may not be possible to locate the previously calculated optimised group of actuator setpoints in the centre of the constrained actuator setpoint search space, for example, where the previously calculated optimised group of actuator setpoints is close to one or more upper or lower constraints of the initial actuator setpoint search space. In such a case, the constrained actuator setpoint range may be defined from the relevant upper or lower actuator constraint, such that the previously calculated optimised group of actuator setpoints is located as centrally as possible within the constrained actuator setpoint search space.

Once the constrained actuator setpoint search space is determined, the optimiser module 50 is configured to perform a stratified sample of the constrained actuator setpoint search space in order to select a second set of candidate groups of actuator setpoints. The stratified sample of the constrained actuator setpoint search space may be performed in substantially the same manner as the stratified sample of the initial actuator setpoint search space. In some embodiments, one of the candidate groups of actuator setpoints may be the optimised group of actuator setpoints that was previously calculated. Thus, the optimiser module 50 ensures that the previous solution is evaluated in the subsequent iteration, and also reduces the number of candidate groups of actuator setpoints within the second set that need to be evaluated.

The optimiser module 50 evaluates the second set of candidate groups of actuator setpoints according to the performance model of the internal combustion engine and calculates a cost associated with each of the second set of candidate groups of actuator setpoints. The evaluation of each of the second set of candidate groups of actuator setpoints may be performed in substantially the same manner as discussed above for the first set of candidate groups of actuator setpoints.

The optimiser module 50 (e.g. second sub-module 52) then determines a further search line in the constrained actuator setpoint search space which spans a second cost minima based on the costs associated with the second set of candidate groups of actuator setpoints.

The optimiser module 50 (e.g. third sub-module 53) then performs a line search along the further search line to calculate a group of actuator setpoints associated with the second cost minima. The optimiser module may perform a line search substantially as described above.

Once the group of actuator setpoints associated with the second cost minima is calculated, the optimiser module evaluates whether a cost reduction has been achieved relative to the first cost minima (i.e. the previously calculated optimised group of actuator setpoints). The optimiser module 50 updates the optimised group of actuator setpoints based on the group of actuator setpoints associated with the second cost minima if a cost reduction is achieved. If no cost reduction is achieved, the optimised group of actuator setpoints is not updated.

Accordingly, the optimiser module may iterate the calculation of the optimised group of actuator setpoints. It will be appreciated from the embodiment of FIG. 6 that the optimiser module 50 may iterate the calculation of the optimised group of actuator setpoints a number of times. Each time the calculation is iterated, the constrained actuator setpoints search space may be further reduced in size relative to the previous calculation. The optimiser module may be arranged to iterate the calculation at least 3 times, at least 5 times, or at least 7 times.

As shown in the embodiment of FIG. 8, the optimiser module 50 includes a termination module 54 configured to decide when to terminate the iterating the optimised group of candidate actuator setpoints. The termination module 54 may terminate the iteration when the cost reduction achieved when updating the optimised group of actuator setpoints falls below a convergence limit; and/or a time taken to perform the iterations exceeds a time limit. A time limit may be defined based on the computational resource available to the optimiser module 50. The time limit may be set such that the optimiser module is allowed to run for e.g. at least 7 times.

Once the termination module 54 of the optimiser module 50 terminates the iteration of the optimised actuator setpoints, the optimised actuator setpoints may be evaluated by the map updating module 40 in order to decide whether to update the control maps.

This disclosure describes the operation an internal combustion engine controller. The internal combustion engine controller described herein comprises one or more processors and have access to one or more memory modules. The processing operations performed by the internal combustion engine controller are described in terms of various modules configured to perform various processing tasks. In some embodiments, the various modules may be performed by distinct computer processors; whilst in other embodiments, some, or all of the processing modules may be performed by a single processor. As such, it will be understood that the processing module described herein may be representative of various functions within a computer program executed by one or more processors.

INDUSTRIAL APPLICABILITY

The internal combustion engine controller 10 of this disclosure may be configured to control an internal combustion engine in variety of configurations.

One application may be for controlling the actuator setpoints of an internal combustion engine as illustrated in FIG. 1. The internal combustion engine may be installed on, for example, a vehicle or piece of machinery, or may form part of a generator.

The invention claimed is:

1. An internal combustion engine controller comprising:

a memory configured to store a plurality of control maps, each control map defining a hypersurface of actuator setpoints for controlling an actuator of the internal combustion engine based on a plurality of input variables to the internal combustion engine controller; and a processor comprising:

an engine setpoint module configured to output an actuator setpoint to each actuator based on a location on the hypersurface of the respective control map defined by the plurality of input variables; and a map updating module configured to optimise one or more of the hypersurfaces of the control maps at the location defined by the plurality of input variables, the map updating module comprising:

an optimiser module configured to search for an optimised group of actuator setpoints by:

(i) performing a stratified sample of an initial actuator setpoint search space of the control maps in order to select a first set of candidate groups of actuator setpoints, and evaluating the first set of candidate groups of actuator setpoints according to a performance model of the internal combustion engine to calculate a cost associated with each of the first set of candidate groups of actuator setpoints, (ii) determining a search line in the initial actuator setpoint search space which spans a first cost minima based on the costs associated with the first set of candidate groups of actuator setpoints;

(iii) performing a line search along the search line to calculate an optimised group of actuator setpoints associated with the first cost minima;

wherein the map updating module updates the one or more hypersurfaces at the location defined by the plurality of input variables based on the optimised group of actuator setpoints.

2. The internal combustion engine controller according to claim 1 wherein the optimiser module is further configured to search for an optimised group of actuator setpoints by:

(iv) performing a stratified sample of a constrained actuator setpoint search space in order to select a second set of candidate groups of actuator setpoints, wherein the constrained actuator setpoint search space is constrained based on the optimised group of actuator setpoints, and evaluating the second set of candidate groups of actuator setpoints according to a performance model of the internal combustion engine to calculate a cost associated with each of the second set of candidate groups of actuator setpoints, (v) determining a further search line in the constrained actuator setpoint search space which spans a second cost minima based on the costs associated with the second set of candidate groups of actuator setpoints;

(vi) performing a line search along the further search line to calculate a group of actuator setpoints associated with the second cost minima;

(vii) updating the optimised group of actuator setpoints based on the group of actuator setpoints associated with the second cost minima if a cost reduction is achieved.

3. The internal combustion engine controller according to claim 2, wherein the optimiser module is configured to repeat the steps of (iv), (v), (vi), and (vii) at least once.

4. The internal combustion engine controller according to claim 3, wherein the optimiser module is configured to repeat the steps of (iv), (v), (vi), and (vii) until:

the cost reduction achieved when updating the optimised group of actuator setpoints falls below a convergence limit; and/or a time taken to perform the search exceeds a time limit.

5. The internal combustion engine controller according to claim 1, wherein one candidate group of actuator setpoints corresponds to the location on each hypersurface defined by the plurality of input variables.

6. The internal combustion engine controller according to claim 5, wherein the map updating module is configured to optimise the hypersurfaces of the control maps by:

determining a cost difference between the cost associated with the optimised group of actuator setpoints and the cost associated with the candidate group of actuator setpoints corresponding to the location on each hypersurfaces of the control maps defined by the plurality of input variables;

wherein if the cost difference is less than an update threshold, the hypersurfaces of the control maps are not updated.

7. The internal combustion engine controller according to claim 2, wherein the search line in the initial actuator setpoint search space and/or the further search line in the constrained actuator setpoint search space is calculated based on the two candidate groups of actuator setpoints with the lowest cost.

8. The internal combustion engine controller according to claim 2, wherein the stratified sample of the initial actuator setpoint search space and/or the stratified sample of the constrained actuator setpoint search space is a Latin Hypercube sample of the respective actuator setpoint search space.

9. The internal combustion engine controller according to claim 1, wherein the initial actuator setpoint search space is defined by upper and lower actuator constraints for each of the control maps.

10. A method of controlling an internal combustion engine comprising:

providing a plurality of control maps, each control map defining a hypersurface of actuator setpoints for controlling an actuator of the internal combustion engine based on a plurality of input variables to the internal combustion engine controller;

outputting an actuator setpoint to each actuator based on a location on the hypersurface of the respective control map defined by the plurality of input variables; and optimising one or more of the hypersurfaces of the control maps at the location defined by the plurality of input variables by:

searching for an optimised group of actuator setpoints including:

(i) performing a stratified sample of an initial actuator setpoint search space of the control maps in order to select a first set of candidate groups of actuator setpoints, and evaluating the first set of candidate groups of actuator setpoints according to a performance model of the internal combustion engine to calculate a cost associated with each of the first set of candidate groups of actuator setpoints, (ii) determining a search line in the initial actuator setpoint search space which spans a first cost minima based on the costs associated with the first set of candidate groups of actuator setpoints;

(iii) performing a line search along the search line to calculate an optimised group of actuator setpoints associated with the first cost minima; and updating the one or more hypersurfaces at the location defined by the plurality of input variables based on the optimised group of actuator setpoints.

11. The method according to claim 10, wherein searching for an optimised group of actuator setpoints further includes:

(iv) performing a stratified sample of a constrained actuator setpoint search space in order to select a second set of candidate groups of actuator setpoints, wherein the constrained actuator setpoint search space is constrained based on the optimised group of actuator setpoints, and evaluating the second set of candidate groups of actuator setpoints according to a performance model of the internal combustion engine to calculate a cost associated with each of the second set of candidate groups of actuator setpoints, (v) determining a further search line in the constrained actuator setpoint search space which spans a second cost minima based on the costs associated with the second set of candidate groups of actuator setpoints;

(vi) performing a line search along the further search line to calculate a group of actuator setpoints associated with the second cost minima;

(vii) updating the optimised group of actuator setpoints based on the group of actuator setpoints associated with the second cost minima if a cost reduction is achieved.

12. The method according to claim 11, wherein the steps of (iv), (v), (vi), and (vii) are repeated at least once.

13. The method according to claim 12, wherein the steps of (iv), (v), (vi), and (vii) are repeated until:

the cost reduction achieved when updating the optimised group of actuator setpoints falls below a convergence limit; and/or a time taken to perform the search exceeds a time limit.

14. The method according to claim 10, wherein one candidate group of actuator setpoints corresponds to the location on each hypersurface defined by the plurality of input variables.

15. The method according to claim 14, wherein the optimising the hypersurfaces of the control maps includes:

determining a cost difference between the cost associated with the optimised group of actuator setpoints and the cost associated with the candidate group of actuator setpoints corresponding to the location on each hypersurfaces of the control maps defined by the plurality of input variables;

wherein if the cost difference is less than an update threshold, the hypersurfaces of the control maps are not updated.

16. The method according to claim 11, wherein the search line in the initial actuator setpoint search space and/or the further search line in the constrained actuator setpoint search space is calculated based on the two candidate groups of actuator setpoints with the lowest cost.

17. The method according to claim 11, wherein the stratified sample of the initial actuator setpoint search space and/or the stratified sample of the constrained actuator setpoint search space is a Latin Hypercube sample of the respective actuator setpoint search space.

18. The method according to claim 10, wherein the initial actuator setpoint search space is defined by upper and lower actuator constraints for each of the control maps.

* * * * *